United States Patent [19]

Schall

[11] 4,436,052

[45] Mar. 13, 1984

[54] GLOBE-SHAPED BELLS WITH SINGLE-PIECE SHELLS

[76] Inventor: William R. Schall, Star Rte. Box 137, Apollo, Pa. 15618

[21] Appl. No.: 388,782

[22] Filed: Jun. 15, 1982

Related U.S. Application Data

[62] Division of Ser. No. 187,395, Sep. 15, 1980, Pat. No. 4,349,065.

[51] Int. Cl.[3] ..... G10K 1/07; G10K 1/26

[52] U.S. Cl. ..... 116/148; 84/103; 116/170; 164/368; 164/365

[58] Field of Search ..... 116/148, 152, 167, 168, 116/170

[56] References Cited

U.S. PATENT DOCUMENTS

| | | | |
|---|---|---|---|
| 390,907 | 10/1888 | Sage | 164/9 |
| 1,170,180 | 2/1916 | O'Dowd | 164/9 |
| 1,474,729 | 11/1923 | Ogden | 164/9 |
| 1,913,107 | 6/1933 | DeBruyne | 164/11 |
| 2,601,839 | 7/1952 | Kucewicz | 116/148 X |
| 2,646,768 | 7/1953 | Fish | 116/148 X |
| 3,254,849 | 6/1966 | Clements | 164/367 X |
| 4,108,104 | 8/1978 | Kupperman et al. | 116/148 |
| 4,180,008 | 12/1979 | Nakamoto | 116/170 |

FOREIGN PATENT DOCUMENTS

| | | | |
|---|---|---|---|
| 53-2819144 | 4/1978 | Japan | 116/148 |

*Primary Examiner*—Daniel M. Yasich

*Attorney, Agent, or Firm*—James Creighton Wray

[57] ABSTRACT

A mold producing one or more globe-shaped bells, each of which is cast as a one-piece shell enclosing a tumbling ball-bearing or jinglet. Production of the one-piece shell is made possible by pouring molten metal over a spherical core, supported by small "feet" inside the globe-like cavity of the mold. When the shell is removed from the mold, the core, in which the ball-bearing or jinglet is embedded, can easily be disintegrated or broken down into particles which fall out holes in the shell's surface.

13 Claims, 3 Drawing Figures

FIG. 1
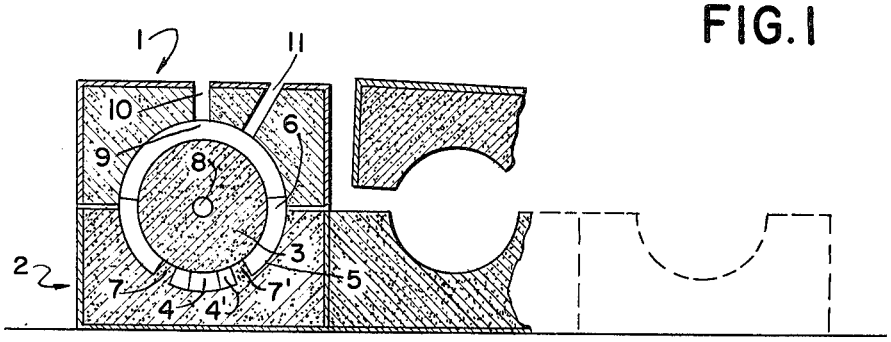
FIG. 2
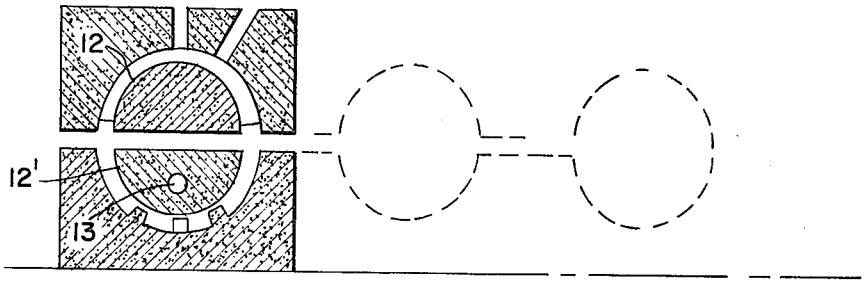
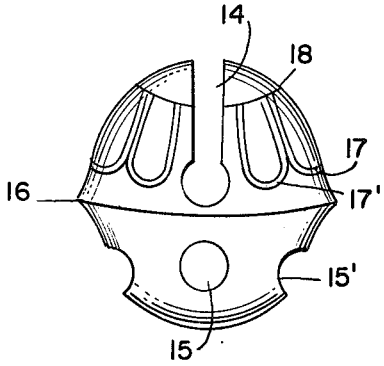
FIG. 3

GLOBE-SHAPED BELLS WITH SINGLE-PIECE SHELLS

This is a division of co-pending application Ser. No. 187,395 filed 9/15/80, now U.S. Pat. No. 4,349,065.

BACKGROUND OF THE INVENTION

The present invention relates to a mold producing one or more globe-shaped bells, each of which is cast as a one-piece shell enclosing a ball-bearing or jinglet which will tumble freely within it.

The shell of conventional globe-shaped bells, which can serve as ornaments, rhythm instruments, warning devices or means of identifying animals or moving objects by sound, is cast in two separate pieces. The upper piece or hemisphere of such a bell is then fused to the lower piece or hemisphere, into which a ball-bearing or jinglet has been placed.

It is the object of the invention to provide a mold producing one or more globe-shaped bells, each of which consists of a ball-bearing or jinglet enclosed in a shell which is cast in one piece in order to reduce the time and cost of production.

It is another object of the invention to provide a globe-shaped bell whose shell is cast in one piece and is, therefore, inherently stronger than a conventional globe-shaped bell whose shell is cast of two pieces which are fused together.

BRIEF DESCRIPTION OF THE DRAWINGS

FIG. 1 shows a cross-section of a portion of a mold producing two or more bells simultaneously. Upper block 1, which, during the casting process, fits flush on lower block 2, is filled with a sand-based or other commercial molding composition. Lower block 2 is filled with the same composition.

Inner core 3, which is formed of the same sand-based or other commercial molding composition, is supported by two or more "feet" 4 which extend from lower block 2's dome-like depression 5, through cavity 6 to the lower surface of inner core 3.

Also extending from lower block 2's dome-like depression 5 through cavity 6 to inner core 3 are two or more round or nearly round protrusions of molding composition, 7 and 7', which will form holes in the surface of the shell, which will be formed in cavity 6 during the casting process. A ball-bearing or jinglet 8 rests securely in the molding composition of inner core 3.

Above inner core 3, extending from upper block 1, is a protrusion in the form of a slit or throat 9. Protrusion 9 will form a slit or throat-shaped hole in the surface of the shell, which will be formed in the cavity during the casting process.

Extending from the top, outer surface of upper block 1 to cavity 6 are fill tunnel 10, through which molten metal is poured during the casting process; and air tunnel 11, through which air can escape during the casting process.

FIG. 2 shows a similar portion of a mold producing two or more bells simultaneously. However, in FIG. 2, the inner core is composed of two separate pieces or hemispheres, 12 and 12'. Ball-bearing of jinglet 13 is embedded in core piece 12'.

FIG. 3 shows a side view of a bell produced from a mold, as shown in FIGS. 1 and 2. It is distinguished by a slit or throat-shaped hole 14 extending across the top of the bell's upper hemisphere.

A bell produced from a mold, as shown in FIGS. 1 and 2, is further distinguished by two or more round or nearly round holes, 15 and 15', which perforate its lower hemisphere. In addition, such a bell may or may not be distinguished by a bulging ring 16 at the point where upper block 1 and lower block 2 of FIG. 1 are joined. Two or more scored parabolas, 17 and 17', extend from a scored circle 18 on the bell's upper hemisphere.

DETAILED DESCRIPTION OF THE INVENTION

The invention is particularly concerned with the production of globe-shaped bells cast as one-piece shells which enclose a tumbling ball-bearing or jinglet.

In order to form such bells in a one-step casting process, molten metal is poured through fill tunnel 10 in FIG. 1. The molten metal then flows through cavity 6, around protrusions 9, 7 and 7' and feet 4 and 4' to form a shell around the inner core 3 of sand-based or other commercial molding composition.

When the shell is cooled and removed from the blocks within which it was formed, the shell is agitated in order to break up the particles which formed the inner core of the mold. Those particles are then shaken out of the holes formed by protrusions 9, 7 and 7'. When all of the particles are shaken out, there will remain a ball-bearing or jinglet 8, as shown in FIG. 1, which will tumble freely within the shell.

Bells formed by the process described above range in size from 0.050–3 inches in diameter, although 0.065–1.8 inches in diameter is a preferable size range; are cast from bronze or any other suitable metal; and contain a ball-bearing or any other suitable jinglet.

Each such bell may be distinguished by two or more holes in its lower surface, although 2 to 4 is a preferable number; may be distinguished by one slit or throat-shaped hole or two intersecting slit or throat-shaped holes on its upper surface; may be distinguished by a decorative, scored circle on its upper surface; may be distinguished by two or more parabolas extending from such a circle on its upper surface, although 6 to 8 is a preferable number; may be distinguished by a bulging ring 16, as shown in FIG. 3; or may be distinguished by no such ring or scored marking of any kind.

Because a mold section, as shown in FIGS. 1 and 2, can be easily attached to one or more identical mold sections to speed the casting process when more than one bell is desired, a multiple casting mold can be produced which can accomodate about 2 to 200 bells, although about 8–48 is a preferable number.

What is claimed is:

1. A globe-shaped or nearly globe-shaped bell, comprising a metal shell with holes extending through the shell, which is molded in only one piece around a readily disintegrative substance forming an inner core; and a ball-bearing or jinglet, which, during the process of casting the shell, is held in place securely in said disintegrative inner core of the shell's mold.

2. The bell in claim 1, which, following removal from an exterior mold, acquires its ringing or jingling capacity by means of the breakdown and removal of the substance which formed the inner core.

3. The bell in claim 1, whose shell's upper hemisphere is distinguished by a perforation in the form of a slit.

4. The bell in claim 3, whose shell's upper hemisphere's exterior surface is distinguished by a scored circle, which is smaller than and concentric with the equator of the shell.

5. The bell in claim 4, whose shell's upper hemisphere's exterior surface is distinguished by two or more scored parabolas extending, arc downward, from the scored circle to a length equal to or nearly equal to the length of the the slit or throat.

6. The bell in claim 4 whose shell's upper hemisphere's exterior surface is distinguished by 6 to 8, scored parabolas extending, arc downward, from the scored circle to a length equal to or nearly equal to the length of the slit or throat.

7. The bell of claim 3 further comprising an enlarged radius opening through the shell at one end of the slit.

8. The bell in claim 1, whose shell's lower hemisphere is distinguished by two or more round or nearly round said holes.

9. The bell in claim 1, whose shell's exterior surface is distinguished by a bulging ring at the point where the two pieces of its mold were joined.

10. The bell in claim 1, whose shell's upper hemisphere is distinguished by two said holes in the form of slits, which intersect at a right angle and cut each other into halves.

11. The globe-shaped bell of claim 1 wherein the jinglet is of a size larger than any opening in the shell, and wherein the shell is unworked by enlarging or by closing any opening sufficiently to receive or capture the jinglet.

12. A globe-shaped bell comprising a unitary molded one piece metal shell that is molded around an easily readily disintegrative core, said shell having spaced openings extending therethrough and having a jinglet held in place within the shell.

13. The bell of claim 12 wherein the jinglet is larger than any opening through the shell.

* * * * *